US009493317B2

(12) United States Patent
Morimoto

(10) Patent No.: US 9,493,317 B2
(45) **Date of Patent: *Nov. 15, 2016**

(54) PAPER FEED APPARATUS, IMAGE READING APPARATUS COMPRISING PAPER FEED APPARATUS, AND IMAGE FORMING APPARATUS COMPRISING PAPER FEED APPARATUS

(71) Applicant: SHARP KABUSHIKI KAISHA, Osaka-shi, Osaka (JP)

(72) Inventor: Yasumasa Morimoto, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/996,620

(22) Filed: Jan. 15, 2016

(65) Prior Publication Data

US 2016/0130099 A1 May 12, 2016

Related U.S. Application Data

(62) Division of application No. 14/311,391, filed on Jun. 23, 2014, now Pat. No. 9,266,691.

(30) Foreign Application Priority Data

Jun. 24, 2013 (JP) ..... 2013-131580
Mar. 6, 2014 (JP) ..... 2014-043395

(51) Int. Cl.

| | |
|---|---|
| ***B65H 3/06*** | (2006.01) |
| ***B65H 1/26*** | (2006.01) |
| ***B65H 1/08*** | (2006.01) |
| ***B65H 3/34*** | (2006.01) |
| ***B65H 1/04*** | (2006.01) |
| *B65H 7/02* | (2006.01) |
| *B65H 43/02* | (2006.01) |

(52) U.S. Cl.

CPC ..... *B65H 3/0684* (2013.01); *B65H 1/04* (2013.01); *B65H 1/08* (2013.01); *B65H 1/26* (2013.01); *B65H 3/0615* (2013.01); *B65H 3/34* (2013.01); *B65H 7/02* (2013.01); *B65H 43/02* (2013.01); *B65H 2801/06* (2013.01); *B65H 2801/39* (2013.01)

(58) Field of Classification Search

CPC ..... B65H 7/02; B65H 43/02
See application file for complete search history.

(56) References Cited

U.S. PATENT DOCUMENTS

| | | | | |
|---|---|---|---|---|
| 7,128,317 | B2 * | 10/2006 | Johnson | B65H 1/04 271/121 |
| 8,160,487 | B2 | 4/2012 | Hashimoto | |
| 2008/0169598 | A1 | 7/2008 | Lee | |
| 2012/0193863 | A1 | 8/2012 | Harada | |

FOREIGN PATENT DOCUMENTS

| | | | |
|---|---|---|---|
| CN | 101441428 | B | 1/2011 |
| JP | 2002-255363 | A | 9/2002 |
| TW | 200829497 | A | 7/2008 |

* cited by examiner

*Primary Examiner* — Howard Sanders
(74) *Attorney, Agent, or Firm* — Birch, Stewart, Kolasch & Birch, LLP

(57) ABSTRACT

A paper feed apparatus includes a paper feeding portion that sends-out a paper placed in a paper placing tray, and is used in an image forming apparatus such as a multifunction machine. The paper feed apparatus comprises a first regulating portion and a second regulating portion that are arranged in the vicinity of a downstream side of a paper feeding position by the paper feeding portion. The first regulating portion is arranged outside a second width paper passage area to regulate a movement of a first width paper such as A4 paper placed in the paper placing tray toward a feeding direction. On the other hand, the second regulating portion is arranged inside the second width paper passage area to regulate a movement of a second width paper such as a name card placed in the paper placing tray toward a feeding direction. Since there are provided with the first regulating portion and the second regulating portion that are arranged outside and inside the second width paper passage area, the second width paper such as a name card can be adequately fed in addition to the first width paper such as A4 paper.

14 Claims, 10 Drawing Sheets

PAPER FEED APPARATUS, IMAGE READING APPARATUS COMPRISING PAPER FEED APPARATUS, AND IMAGE FORMING APPARATUS COMPRISING PAPER FEED APPARATUS

CROSS REFERENCE OF RELATED APPLICATIONS

This application is a Divisional of co-pending application Ser. No. 14/311,391, filed on Jun. 23, 2014 and for which priority is claimed under 35 U.S.C. §120, which claims priority of Application Nos. 2013-131580 and 2014-043395 filed in Japan on Jun. 24, 2013 and Mar. 6, 2014, under 35 U.S.C. §119; the entire contents of all are hereby incorporated by reference.

BACKGROUND OF THE INVENTION

Field of the Invention

The present invention relates to a paper feed apparatus, an image reading apparatus comprising a paper feed apparatus and an image forming apparatus comprising an image reading apparatus, and more specifically, a paper feed apparatus that is provided on an image forming apparatus such as a copying machine, a facsimile, a printer, a multifunction machine, etc. and feeds a paper placed in a paper placing tray, an image reading apparatus comprising the paper feed apparatus, and an image forming apparatus comprising the image reading apparatus.

Description of the Related Art

One example of a background art is disclosed in Japanese Patent Application Laying-open No. 2002-255363 [B65H 1/04] laid-open on Sep. 11, 2002 (Patent Literature 1). A paper feed apparatus in Patent Literature 1 comprises a pickup roller (a paper feeding portion) that sends-out an original placed in an original feeding tray. In the vicinity of a downstream side of a paper feeding position by the pickup roller, there are provided with shutters (a regulating portion) that interrupt the original not to be pushed into a separating roller in placing the original. The shutters are provided rotatably at both sides of the pickup roller, and rotations thereof are regulated by a stopper that is slipped off in synchronous with a descent of the pickup roller.

Recently, in an image forming apparatus such as a copying machine, a facsimile, a printer, a multifunction machine compounding these, etc., a machine capable of dealing with not only a paper (first width paper) having an ordinary width that is normally used such as A4 paper, A3 paper, etc. but also a paper (second width paper) having a small width that is smaller in size than the first width paper such a name card, post card, etc. is desired. Therefore, a function that can adequately feed the second width paper is also required in a paper feed apparatus. However, in the art disclosed in Patent Literature 1, since the regulating portions are arranged at positions corresponding to both end portions in a width direction of the first width paper that is normally used, and the regulation for the second width paper such as a name card having a smaller width than the first width paper is never considered. Therefore, it is impossible to adequately feed the second width paper.

SUMMARY OF THE INVENTION

Therefore, it is a primary object of the present invention to provide a novel a paper feed apparatus, an image reading apparatus comprising a paper feed apparatus and an image forming apparatus comprising an image reading apparatus.

It is another object of the present invention to provide a paper feed apparatus, an image reading apparatus comprising a paper feed apparatus and an image forming apparatus comprising an image reading apparatus, capable of adequately feeding a second width paper such as a name card in addition to a first width paper such as A4 paper that is normally used.

The present invention adopts following structure in order to solve the above-described problem.

A first invention is a paper feed apparatus that feeds a paper placed in a paper placing tray, comprising: a paper feeding portion that sends-out a paper placed in the paper placing tray; a first regulating portion that regulates a movement of a first width paper placed in the paper placing tray in a feeding direction, in the vicinity of a downstream side of a feeding position by the paper feeding portion in a paper feeding direction and outside a second width paper passage area in a direction orthogonally intersecting the paper feeding direction; and a second regulating portion that regulates a movement of a second width paper placed in the paper placing tray and having a smaller width than the first width paper in a feeding direction, in the vicinity of the downstream side of the feeding position by the paper feeding portion in the paper feeding direction and inside the second width paper passage area in the direction orthogonally intersecting the paper feeding direction.

In the first invention, the paper feed apparatus is an apparatus that is for automatically feeding a paper placed in the paper placing tray, and used in an image forming apparatus such as a copying machine, a facsimile, a printer, a multifunction machine compounding these, etc. The paper feed apparatus comprises the paper feeding portion that sends-out the paper placed in the paper placing tray, and the first regulating portion and the second regulating portion that are for preventing unintentional entering of the paper in the vicinity of the downstream side of the paper feeding direction at the feeding position by the paper feeding portion. The first regulating portion is arranged outside the second paper passage area in the direction orthogonally intersecting the paper feeding direction, and regulates the movement of the first width paper such as A4 paper placed in the paper placing tray in the feeding direction. On the other hand, the second regulating portion is arranged inside the second width paper passage area in the direction orthogonally intersecting the paper feeding direction, and regulates the movement of the second width paper having a smaller width than the first width paper in the feeding direction of the second width paper.

According to the first invention, since the first regulating portion is arranged outside the second width paper passage area and the second regulating portion is arranged inside the second width paper passage area, it is possible to adequately regulate the movement of the second width paper such as a name card, whereby the second width paper can be also adequately fed in addition to the first width paper.

A second invention is according to the first invention, wherein the paper feeding portion includes a pickup roller that is provided movably between a standby position and an operation position, and each of the first regulating portion and the second regulating portion regulates a movement of a paper at a time of a standby of the pickup roller and cancels such regulation at a time of an operation of the pickup roller.

In the second invention, the paper feeding portion includes the pickup roller that is provided movably between the standby position and the operation position and sends-out the paper to the paper feeding roller. Then, the first regulating portion regulates the movement of the first width paper at the time of the standby of the pickup roller, that is, when the paper is to be placed in the paper placing tray, and cancels the regulation of the movement of the first width paper at the time of the operation of the pickup roller, that is, when the first width paper is to be sent-out by the pickup roller. On the other hand, the second regulating portion regulates the movement of the second width paper at the time of the standby of the pickup roller, and cancels the regulation of the movement of the second width paper at the time of the operation of the pickup roller.

A third invention is according to the second invention, further comprising a displacement portion that is displaced at the time of the operation of the pickup roller, wherein the regulation of the movement of the paper by the first regulating portion or the second regulating portion is canceled by a displacement of the displacement portion.

In the third invention, there is provided with the displacement portion (in the embodiments, a locking portion or a contacting portion) that is displaced, that is, a position thereof is changed, at the time of the operation of the pickup roller. Then, the regulation of the movement of the first width paper or the second width paper by the first regulating portion or the second regulating portion is canceled by the displacement portion that is displaced at the time of the operation of the pickup roller.

A fourth invention is according to the third invention, further comprising a pickup holder that is provided movably between the standby position and the operation position and holds the pickup roller rotatably, wherein the first regulating portion is arranged out of a width of the pickup holder in the direction orthogonally intersecting the paper feeding direction, and the second regulating portion is arranged within the width of the pickup holder in the direction orthogonally intersecting the paper feeding direction, and the first regulating portion is provided with an engaging mechanism that engages with the displacement portion that is linked with an operation of the pickup roller to regulate or release the movement of the paper, and the first regulating portion and the second regulating portion are integrally coupled to each other to link an operation of the second regulating portion with an operation of the first regulating portion.

In the fourth invention, the pickup holder that is movable between the standby position and the operation position is further provided. The pickup holder holds the pickup roller rotatably. That is, the pickup roller is supported by the pickup holder movably between the standby position and the operation position. The first regulating portion is arranged out of the width of the pickup holder in the direction orthogonally intersecting the paper feeding direction, and the second regulating portion is arranged within the width of the pickup holder in the direction orthogonally intersecting the paper feeding direction. Then, the first regulating portion is provided with the engaging mechanism that engages with the displacement portion. The engaging mechanism regulates the movement of the paper at the time of the standby of the pickup roller and cancels the regulation of the movement of the paper at the time of the operation of the pickup roller. In addition, the second regulating portion is integrally coupled to the first regulating portion, and the operation of the second regulating portion is linked with the operation of the first regulating portion.

According to the fourth invention, it is possible to link the operation of the second regulating portion with the operation of the pickup roller without providing, in the second regulating portion, an engaging mechanism for linking the operation of the second regulating portion with the operation of the pickup roller, whereby a shape of the second regulating portion can be simplified, and thus, it becomes possible to arrange the second regulating portion in a limited space within the pickup holder. That is, the second regulating portion can be adequately arranged inside the second width paper passage area without increasing the size of the apparatus and complicating the apparatus.

A fifth invention is according to the third invention, further comprising a pickup holder that is provided movably between the standby position and the operation position and holds the pickup roller rotatably, wherein the first regulating portion is arranged out of a width of the pickup holder in the direction orthogonally intersecting the paper feeding direction, and the second regulating portion is arranged within the width of the pickup holder in the direction orthogonally intersecting the paper feeding direction, and the first regulating portion and the second regulating portion are integrally coupled to each other to link an operation of the second regulating portion with an operation of the first regulating portion, and the first regulating portion is pushed by the displacement portion to be displaced at the time of the operation of the pickup roller and thus the regulation of the movement of the paper is canceled.

In the fifth invention, the pickup holder that is movable between the standby position and the operation position is further provided. The pickup holder holds the pickup roller rotatably. That is, the pickup roller is supported by the pickup holder movably between the standby position and the operation position. The first regulating portion is arranged out of the width of the pickup holder in the direction orthogonally intersecting the paper feeding direction, and the second regulating portion is arranged within the width of the pickup holder in the direction orthogonally intersecting the paper feeding direction. Then, at the time of the operation of the pickup roller, the first regulating portion is pushed by the displacement portion to be displaced, and therefore, the regulation of the movement of the paper can be canceled. Furthermore, by integrally coupling the first regulating portion and the second regulating portion to each other, the second regulating portion is also displaced in synchronous with the displacement (operation) of the first regulating portion, and at the time of the operation of the pickup roller, the regulation of the movement of the second width paper is also canceled.

According to the fifth invention, it is possible to link the operation of the second regulating portion with the operation of the pickup roller without providing, in the second regulating portion, an engaging mechanism for linking the operation of the second regulating portion with the operation of the pickup roller, whereby a shape of the second regulating portion can be simplified, and thus, the second regulating portion can be adequately arranged inside the second width paper passage area.

A sixth invention is according to the first invention, wherein the first regulating portion and the second regulating portion are arranged at one side of the paper feeding portion.

In the sixth invention, the first regulating portion and the second regulating portion are collectively arranged at one side of the paper feeding portion such as the pickup roller, that is, at one side portion, whereby miniaturization of the apparatus can be achieved.

A seventh invention is according to the first invention, wherein a contacting portion with the paper in the first regulating portion is formed to be inclined toward the paper feeding direction in comparison to a contacting portion with the paper in the second regulating portion.

In the seventh invention, the contacting portion of the first regulating portion with the paper is made larger in inclination than the contacting portion of the second regulating portion with the paper. Due to this, it is possible to adequately feed the first width paper even if the first width paper is an easy-to-curl paper, and to surely regulate the second width paper.

An eighth invention is according to the first invention, wherein a contacting portion with the paper in the first regulating portion is arranged at an upstream side of the paper feeding direction in comparison to a contacting portion with the paper in the second regulating portion.

In the eighth invention, the contacting portion of the first regulating portion with the paper is arranged at the upstream side of the paper feeding direction in comparison to the contacting portion of the second regulating portion with the paper. Due to this, since the first width paper placed in the paper placing tray is brought into contact with the first regulating portion previously, a regulation performance to the first width paper can be secured.

A ninth invention is according to the first invention, wherein a height of the first regulating portion is set to be higher than a height of the second regulating portion.

In the ninth invention, the height (a protruding height from the paper placing tray) of the first regulating portion is set to be higher than the height of the second regulating portion. Due to this, it is possible to adequately regulate the first width paper even if the first width paper is an easy-to-curl paper.

A tenth invention is an image reading apparatus comprising the paper feed apparatus according to the first invention.

In the tenth invention, the image reading apparatus comprises the paper feed apparatus comprising the paper feeding portion that sends-out the paper placed in the paper placing tray, the first regulating portion and the second regulating portion that are for preventing intentional entering of the paper in the vicinity of the downstream side of the paper feeding position by the paper feeding portion.

According to the tenth invention, an operation and an advantage similar to those of the first invention can be expected, and it is possible to adequately feed the second width paper such as a name card in addition to the first width paper such as A4 paper.

An eleventh invention is an image forming apparatus comprising the image reading apparatus according to the tenth invention.

In the eleventh invention, the image forming apparatus is a multifunction machine, for example, that includes a machine body and the image reading apparatus provided with the paper feed apparatus. The paper feed apparatus comprises the paper feeding portion that sends-out the paper placed in the paper placing tray, the first regulating portion and the second regulating portion that are for preventing intentional entering of the paper in the vicinity of the downstream side of the paper feeding position by the paper feeding portion.

According to the tenth invention, an operation and an advantage similar to those of the tenth invention can be expected, and it is possible to adequately feed the second width paper such as a name card in addition to the first width paper such as A4 paper.

The above described objects and other objects, features, aspects and advantages of the present invention will become more apparent from the following detailed description of the present invention when taken in conjunction with the accompanying drawings.

DETAILED DESCRIPTION OF NON-LIMITING EXAMPLE EMBODIMENTS

[First Embodiment]

Figure 1:
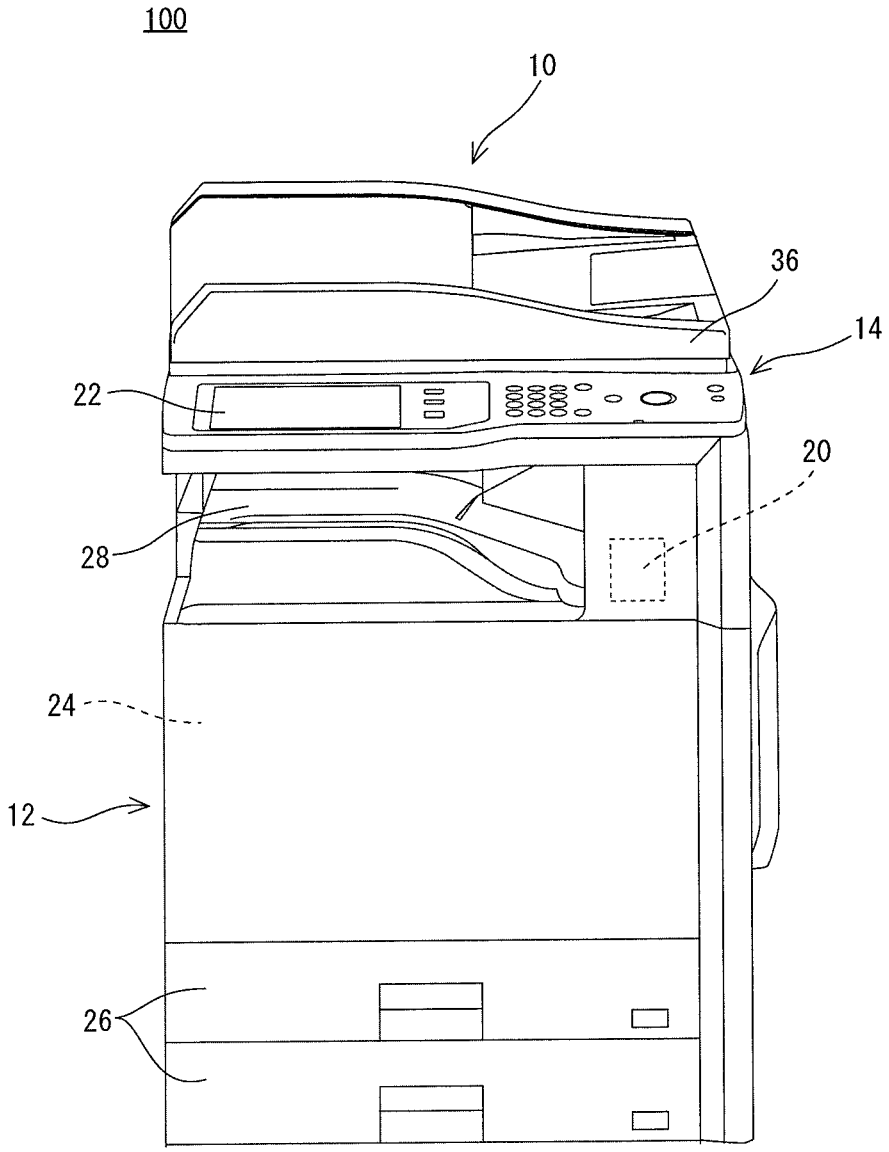
FIG. 1 is a schematic view showing an appearance of an image forming apparatus that is provided with a paper feed apparatus of a first embodiment according to the present invention.
Figure 2:
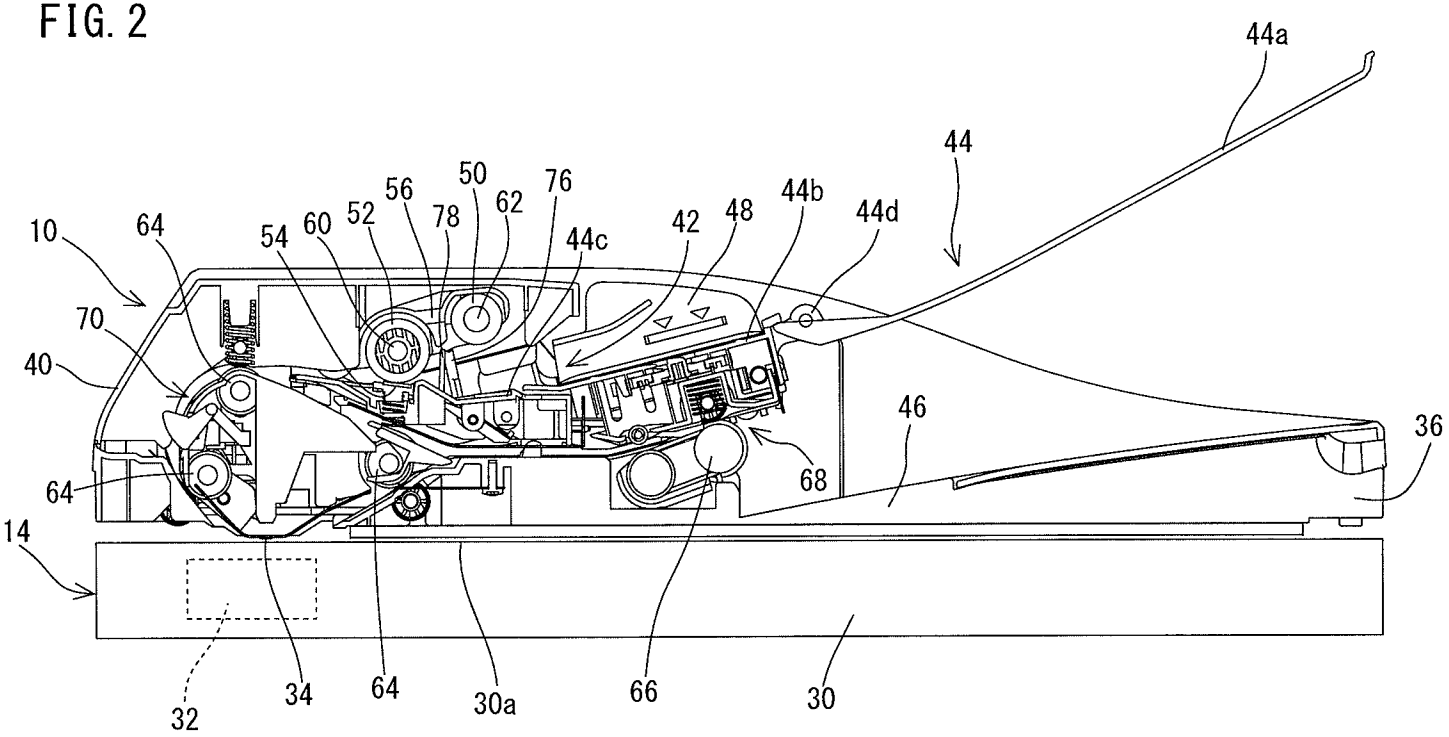
FIG. 2 is a schematic cross-sectional view showing internal structure of the paper feed apparatus of FIG. 1.

With referring to FIG. 1 and FIG. 2, a paper feed apparatus 10 of one embodiment according to the present invention is used in an image forming apparatus such as a copying machine, a facsimile, a printer, a multifunction machine compounding these, etc. As details will be described later, the paper feed apparatus 10 comprises a paper placing tray 44, a pickup roller 50, a paper feeding roller 52, a first regulating portion 76, a second regulating portion 78, etc., and automatically feeds a paper (an original) placed in the paper placing tray 44 to an image reading position 34 one by one. In this first embodiment, an example that the paper feed apparatus 10 is applied to a multifunction machine 100 having a copying machine function, a printer function, a scanner function, a facsimile function, etc. is shown.

First, structure of the multifunction machine 100 is roughly described. As shown in FIG. 1 and FIG. 2, the multifunction machine 100 includes a machine body 12, an image reading apparatus 14 and the paper feed apparatus 10.

A control portion 20 that controls operations of respective components of the multifunction machine 100 is provided at a predetermined position in the machine body 12. The control portion 20 comprises a CPU, memories, etc., and transmits control signals according to an input operation to an operating portion 22 by a touch panel, operating button, etc. to respective components of the multifunction machine 100 to make the multifunction machine 100 perform a various kinds of operations.

Furthermore, an image forming apparatus 24 that is provided with an exposure unit, a photoreceptor drum, a charging unit, a developing unit, a fixing roller, etc. is incorporated within the machine body 12. The image forming apparatus 24 forms an image on a recording paper that is fed from a paper cassette 26 or the like, and discharges the recording paper on that the image has been formed onto a discharging tray 28. As image data for forming an image on a recording paper, image data read by an image reading portion 32, image data transmitted by an external computer, etc. can be utilized.

In addition, the image reading apparatus 14 comprises a housing 30 that has an original platen 30*a* made of a transparent material on a top surface thereof. Within the housing 30, there is provided with the image reading portion 32 that comprises a light source, a plurality of mirrors, a focusing lens, a line sensor, etc. In the image reading portion 32, an original surface is exposed by the light source, and a reflected light that is reflected by the original surface is conducted to the focusing lens by the plurality of mirrors. Then, the reflected light is focused onto photoreceptors of the line sensor by the focusing lens. In the line sensor, a luminance and a chromaticity of the reflected light being focused on the photoreceptors are detected to produce image data based on the image of the original surface. As the line sensor, it is preferable to use a CCD (Charge Coupled Device), a CIS (Contact Image Sensor), etc.

In addition, the image reading portion 32 has a home position at a position opposite to an image reading position 34, and in a case where an image of an original placed in the paper placing tray 44 is to be read, the image reading portion 32 reads an image on the original surface when the original passes the image reading position 34, thereby to acquire image data. Furthermore, in a case where an image of an original that is put on the original platen 30*a* on the upper surface of the housing 30 is to be read, by adequately moving the light source, mirrors, etc. beneath the original platen 30*a*, the image of the original is read, thereby to acquire image data.

In addition, a platen cover 36 is attached to the original platen 30*a* of the image reading apparatus 14 in an openable/closable manner via a hinge. The paper feed apparatus 10 is provided on the platen cover 36.

In the following, structure of the paper feed apparatus 10 will be specifically described by adequately referring to FIG. 2 to FIG. 9. In addition, it should be noted that a term "upstream" or "downstream" means, in this specification, an upstream or a downstream in an original feeding direction (paper feeding direction).

As shown in FIG. 2, the paper feed apparatus 10 is an apparatus that successively feeds an original (paper) that an image is to be read from the paper placing tray 44 to the paper discharging tray 46 via the image reading position 34, and provided with a machine body casing 40 that is made of a synthetic resin and forms an outer shell. A paper feeding port 42 is formed in an upper portion of the machine body casing 40 and the paper placing tray 44 is provided to be extended from a bottom surface of the paper feeding port 42 obliquely upward. The paper placing tray 44 includes an upstream part 44*a*, a midstream part 44*b* and a downstream part 44*c*, and the upstream part 44*a* is formed in a plate-like and each of the midstream part 44*b* and the downstream part 44*c* is formed in a casing-like. The upstream part 44*a* of the paper placing tray 44 is coupled to the midstream portion 44*b* by an opening/closing fulcrum 44*d* that extends in a width direction to be rotatable to the midstream portion 44*b*, and by rotating the upstream part 44*a*, the paper feeding port 42 is opened or closed. Furthermore, a pair of side guides 48 that are movable in the width direction are provided on an upper surface of the midstream part 44*b* of the paper placing tray 44. The side guides 48 regulate the original placed in the paper placing tray 44 from both sides to be aligned.

Figure 3:
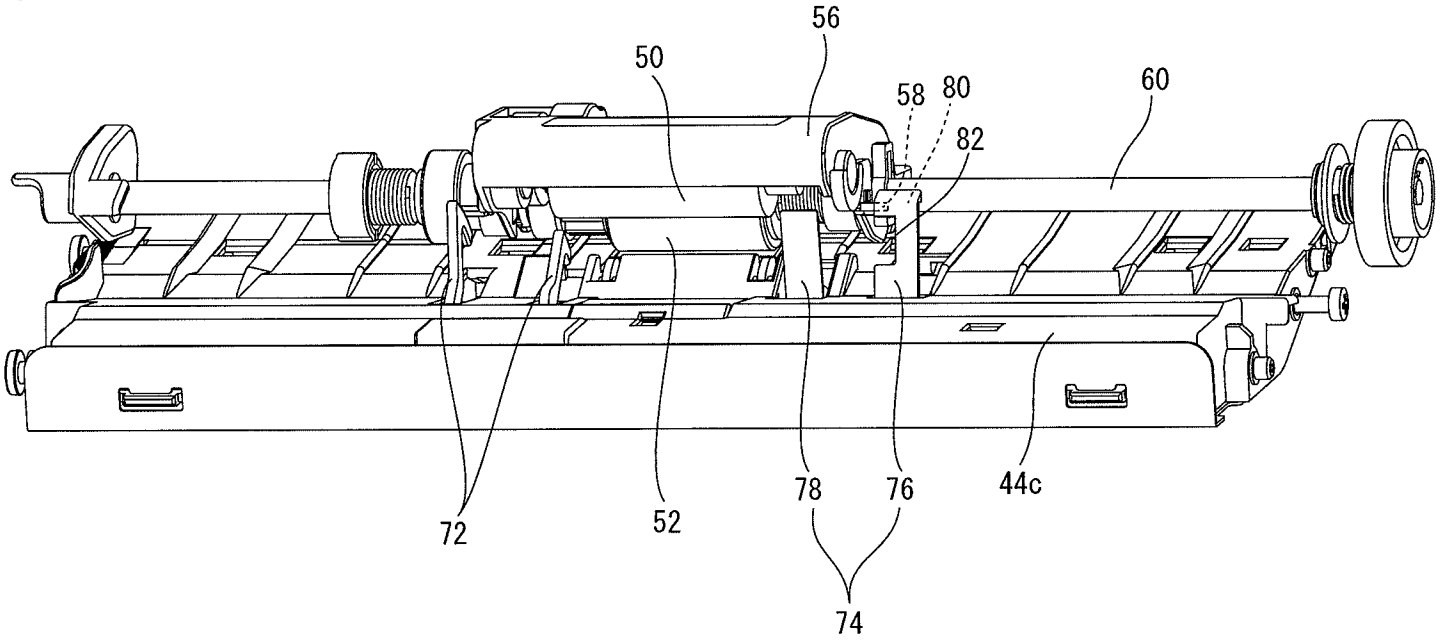
FIG. 3 is a schematic view showing a portion of a paper feeding port of the paper feed apparatus of FIG. 1 in a state that a pickup roller is ascended.
Figure 4:
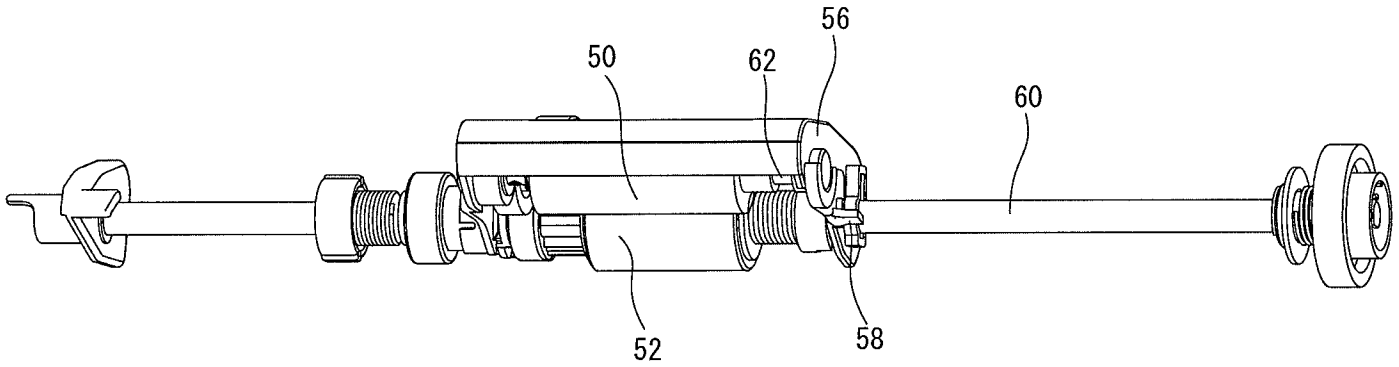
FIG. 4 is a schematic view showing structure of the pickup roller and a paper feeding roller that are provided in the paper feed apparatus of FIG. 1.

As shown in FIG. 2 to FIG. 4, a pickup roller 50 functioning as a paper feeding portion that sends-out a paper placed in the paper placing tray 44 is provided above the downstream part 44*c* of the paper placing tray 44 within the machine body casing 40. At the downstream side of the pickup roller 50, a paper feeding roller 52 and a paper separating portion 54 are provided, and a pickup holder 56 is provided so as to cover the pickup roller 50 and the paper feeding roller 52 at upper parts and surroundings. A locking portion 58 that is protruded outward is formed on one sidewall of the pickup holder 56. The locking portion 58 is engaged with an engaging portion 80 of the first regulating portion 76 at a time of a standby (a time of an ascent) of the pickup roller 50 to regulate a rotation of the first regulating portion 76. Furthermore, the locking portion 58 functions a displacement portion that changes a position at a time of an operation (a time of a descent) of the pickup roller 50. At the time of the operation of the pickup roller 50, by changing a position of the locking portion 58, an engagement between the locking portion 58 and the engaging portion 80 of the first regulating portion 76 can be released.

A rotation shaft 60 that rotates the paper feeding roller 52 is supported on the side walls of the machine body casing 40, and the pickup holder 56 is attached to the rotation shaft 60 to be rotatable in a vertical direction (movable up and down). In addition, a rotation shaft 62 that rotates the pickup roller 50 is supported on side walls of the pickup holder 56. That is, the pickup roller 50 is supported by the pickup holder 56 to be movable upward and downward around the rotation shaft of the paper feeding roller 52. Before the original placed in the paper placing tray 44 is fed, the pickup roller 50 is ascended since the pickup holder 56 is rotated upward, and the pickup roller 50 and the pickup holder 56 are held at the standby position that is a state that the pickup roller 50 is separated from an upper surface of the original (paper) being placed (see FIG. 3). When the original is to be fed, the pickup roller 50 moves downward since the pickup holder 56 is rotated downward, and the pickup roller 50 and the pickup holder 56 are moved to the operation position that is a state that the pickup roller 50 is brought into contact with the upper surface of the original being placed and thus the original can be sent-out (see FIG. 9). In addition, the pickup roller 50 is driven to rotate together with the paper feeding roller 52 by a driving force that is transmitted from a paper feeding motor (not shown).

Returning to FIG. 2, at the downstream side of the paper feeding roller 52, a plurality of feeding rollers 64 and a paper discharging roller 66 are provided, and within the machine body casing 40, an original feeding path 70 that is extended from the paper feeding port 42 to a paper discharging port 68 via the image reading position 34 is formed. In addition, at the downstream side of the paper discharging port 68, there is provided with a paper discharging tray 46.

Figure 5:
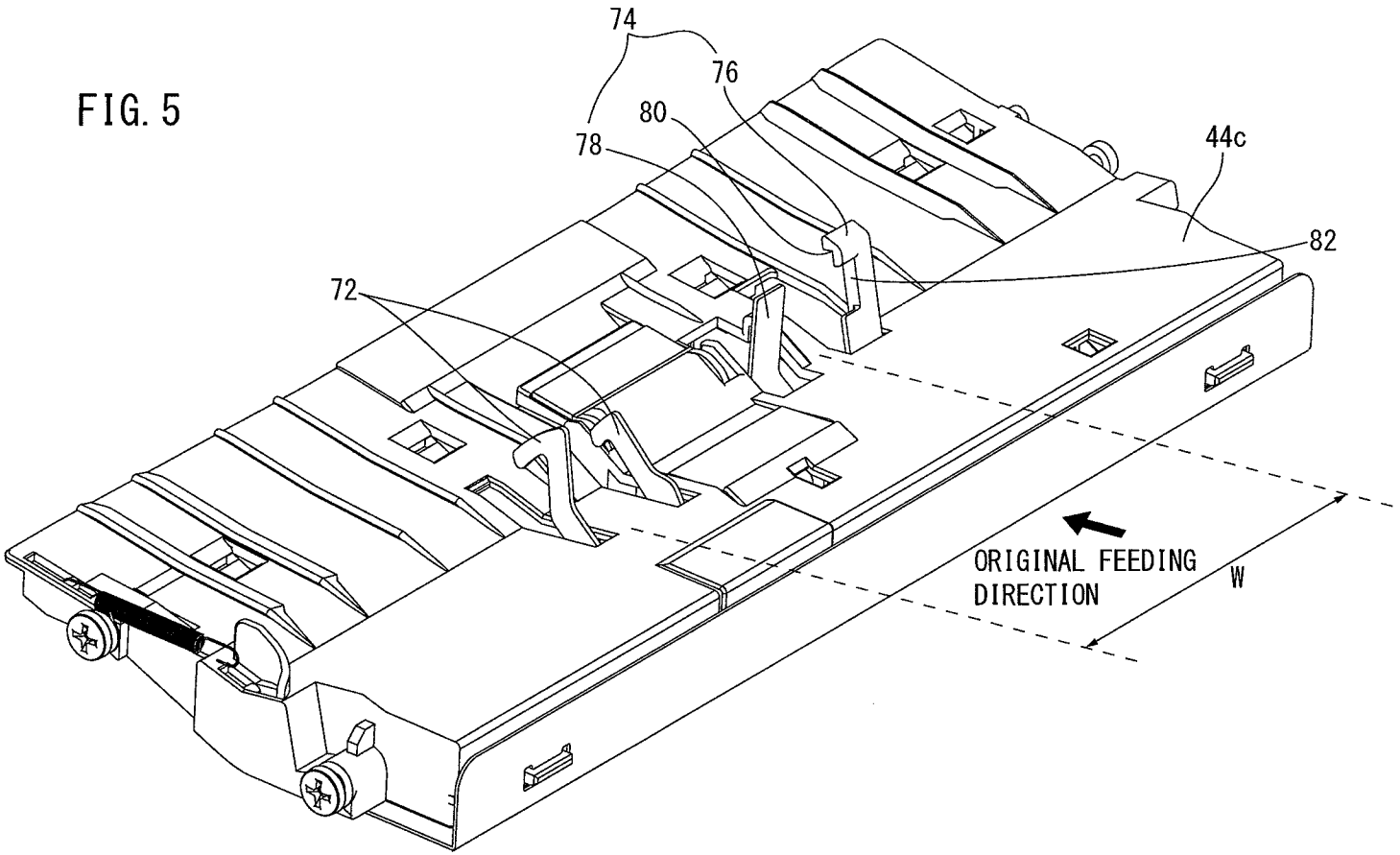
FIG. 5 is a schematic view showing structure of a lower part of a paper placing tray and a regulating member that are provided in the paper feed apparatus of FIG. 1.

Furthermore, as shown in FIG. 3 and FIG. 5, a setting detecting member 72 and a regulating member 74 are provided on the downstream part 44*c* of the paper placing tray 44. The setting detecting member 72 is a member for detecting that an original has been placed in the paper placing tray 44. If the setting detecting member 72 is rotated forward (original feeding direction) due to a front end of the original coming into contact with the setting detecting member 72, this is detected by a photo sensor or the like as an original placing state.

The regulating member 74 is a member for regulating a movement of the original toward the downstream side in the vicinity of the downstream side of the paper feeding position by the pickup roller 50 in order to prevent intentional entering of the original into the paper feeding roller 52 when the original is placed in the paper placing tray 44. In this first embodiment, the regulating member 74 is constructed such that the regulating member can properly deal with not only a first width paper of an ordinary width that is normally used such as A4 paper, A3 paper, B4 paper, B3 paper, etc. but also a second width paper having a size smaller than the first width paper and thus a small width such as a name card, a postcard, etc. In addition, a term "the paper feeding position" means a position that the pickup roller 50 is brought into contact with the original.

Specifically, the regulating member 74 comprises, as shown in FIG. 3 and FIG. 5 to FIG. 8, the first regulating portion 76 and the second regulating portion 78 that are arranged at a side of one end portion (one side) in an axial direction of the pickup roller 50. The first regulating portion 76 is inclined toward the downstream side at a predetermined angle, and arranged outside a passage area W that the second width paper passes (a second width paper passage area W: a range of a width 91 mm centering a center of the width of the paper placing tray 44, for example (see FIG. 5)) in a direction orthogonally intersecting the original feeding direction and out of a width of the pickup holder 56 in the direction orthogonally intersecting the original feeding direction. The engaging portion 80 that engages with the locking portion 58 that is formed on an outside surface of the pickup holder 56 is formed at a tip end of the first regulating member 76, and a notch 82 is formed below the engaging portion 80.

On the other hand, the second regulating 78 includes a first piece 78*a* that is largely inclined toward the downstream side in comparison to the first regulating member 76 and a second piece 78*b* that is bent upward from a tip end of the first piece 78*a* and extended in an approximately vertically upward, and is arranged inside the second width paper passage area W and within the width of the pickup holder 56 in the direction orthogonally intersecting the original feeding direction. In addition, the second piece 78*b* of the second regulating member 78 is rendered to be positioned at the downstream side in comparison to the first regulating portion 76. Furthermore, a height of the second regulating portion 78 is set to be lower than a height of the first regulating portion 76, and the second regulating portion 78 is fit into the pickup holder 56 at the time of the descent of the pickup roller 50.

Figure 6:
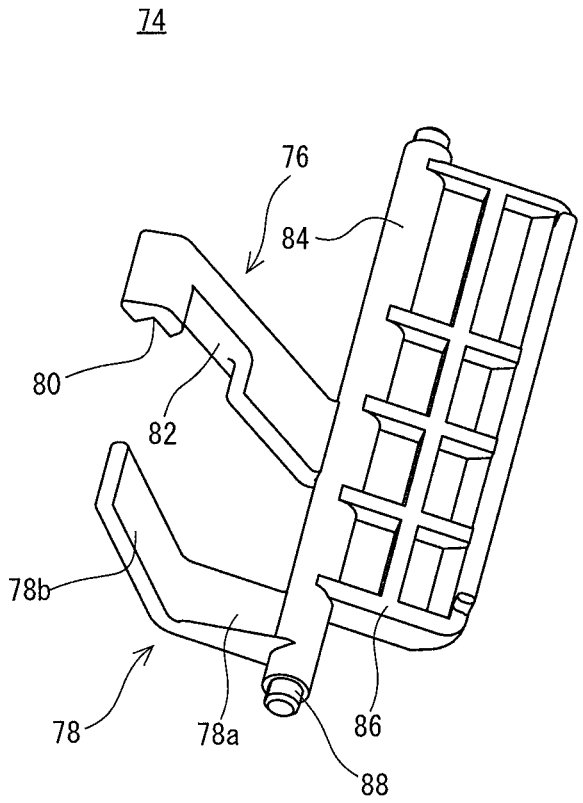
FIG. 6 is a perspective view showing the regulating member provided in the paper feed apparatus of FIG. 1.
Figure 7:
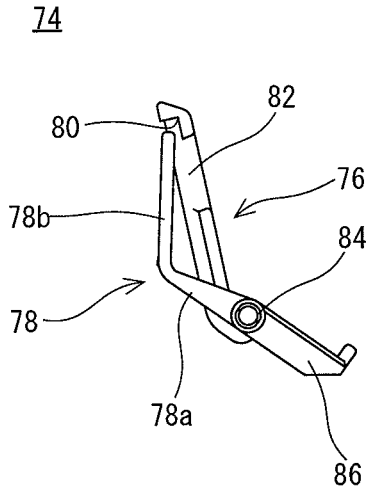
FIG. 7 is a side view showing the regulating member provided in the paper feed apparatus of FIG. 1.
Figure 8:
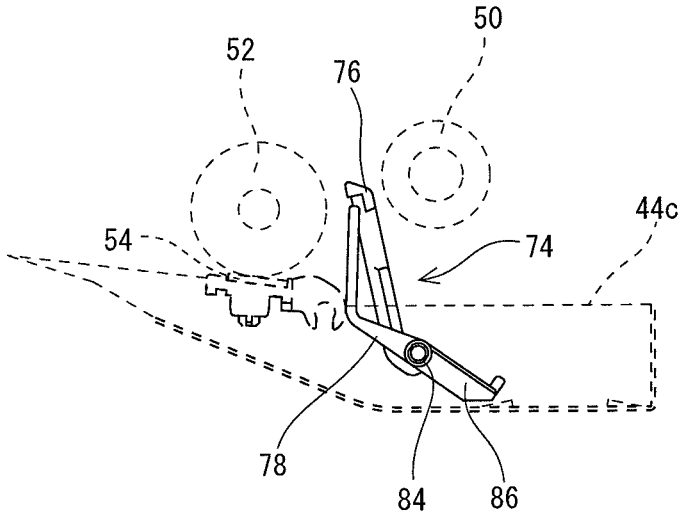
FIG. 8 is a schematic view showing a positional relationship between a first regulating portion and a second regulating portion that are provided in the paper feed apparatus of FIG. 1.

As shown in FIG. 6, a base end part of the first regulating portion 76 and a base end part of the second regulating portion 78 are coupled to each other by a coupling portion 84 that is a circular cylinder-like, and a plate-like weight 86 that protrudes a direction opposite to the regulating portions 76 and 78 is provided on the coupling portion 84. A supporting shaft 88 that is supported on the side walls of the downstream part 44*c* of the paper placing tray 44 is inserted into the coupling portion 84, and the regulating member 74 is supported by the supporting shaft 88 in a rotatable manner. That is, the first regulating portion 76 and the second regulating portion 78 are rotatable with a fulcrum by the supporting shaft 88. When no force from others affecting, the weight 86 descends by its own weight, and therefore, the first regulating portion 76 and the second regulating portion 78 become in a standing state. As understood well from FIG. 5 and FIG. 8, in such a standing state, an upper part of the first regulating portion 76 and the second piece 78*b* of the second regulating portion 78 become in a state that these are protruded from the upper surface of the downstream part 44*c* of the paper placing tray 44. That is, each of the upper part of the first regulating portion 76 and the second piece 78*b* of the second regulating portion 78 becomes a contacting portion that is brought into contact with the original placed in the paper placing tray 44.

In addition, a difference between the inclination angles of the first regulating portion 76 and the second piece 78*b* of the second regulating portion 78 is due to a difference of papers that become objects to be regulated. That is, because the first width paper such as A4 paper is thinner in comparison to the second width paper such as a name card and thus easy to be curled, the first regulating portion 76 is inclined toward the original feeding direction such that the first width paper that is curled can be properly fed. On the other hand, the second piece 78*b* of the second regulating portion 78 that regulates the movement of the second width paper that is relatively thicker and thus difficult to be curled is formed to be extended upward in approximately vertical direction, whereby intentional entering of the second width paper can be surely regulated. Furthermore, a reason why the height of the first regulating portion 76 (a protruding height from the paper placing tray 44) is set higher than the height of the second regulating portion 78 is for surely regulating intentional entering of the first width paper by surely bringing contact into the first regulating portion 76 even if the first width paper that is curled. On the other hand, as for the second regulating portion 78 that regulates the movement of the second width paper that is difficult to be curled, by suppressing the height lower, the second regulating portion 78 is rendered to be properly fit into the pickup holder 56. Furthermore, by arranging the first regulating portion 76 at the upstream side in comparison to the second piece 78*b* of the second regulating portion 78, a regulating performance can be ensured because the first width paper placed in the paper placing tray 44 is previously brought into contact with the first regulating portion 76.

In such the paper feed apparatus 10, when an original is to be placed in the paper placing tray 44, the pickup roller 50 is held in the ascent position (standby position) (see FIG. 3). At this time, the locking portion 58 of the pickup holder 56 and the engaging portion 80 of the first regulating portion 76 are rendered in an engagement state, and therefore, in the standing state, a rotation of the first regulating portion 76 is regulated by the locking portion 58. Furthermore, since the rotation of the first regulating portion 76 is regulated, a rotation of the second regulating portion 78 that is integrally coupled to the first regulating portion 76 is also regulated in the standing state.

Then, in a case where the first width paper such as A4 paper is placed in the paper placing tray 44, the first width paper is brought into contact with the first regulating portion 76 that is arranged at the upstream side in comparison to the second regulating portion 78, whereby the movement of the first width paper in the feeding direction can be regulated and the first width paper can be aligned. On the other hand, in a case where the second width paper such as a name card is placed in the paper placing tray 44, the second width paper is brought into contact with the second regulating portion 78 (the second piece 78*b*) that is arranged inside the second width paper passage area W, whereby the movement of the second width paper in the feeding direction can be regulated and the second width paper can be aligned.

Thus, in the first embodiment, not only the first width paper, the movement of the second width paper such as a name card can be also adequately regulated.

Figure 9:
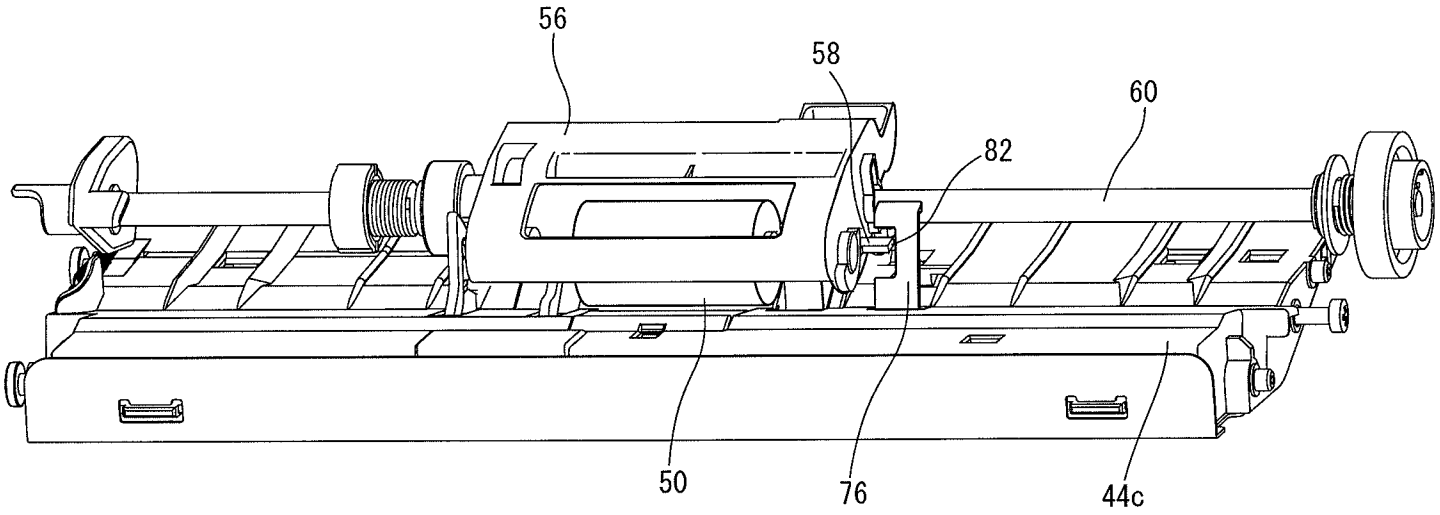
FIG. 9 is a schematic view showing a portion of a paper feeding port of the paper feed apparatus in a state that the pickup roller is descended.

In addition, when an image is to be read by feeding the original placed in the paper placing tray 44, as shown in FIG. 9, the pickup roller 50 is driven for rotation and the pickup holder 56 is rotated downward such that the pickup roller 50 is moved to the descent position (operation position). At this time, the locking portion 58 of the pickup holder 56 is brought at a height of the notch 82 of the first regulating portion 76, and therefore, the engagement of the locking portion 58 of the pickup holder 56 and the engaging portion 80 of the first regulating portion 76 is released. That is, since the locking portion 58 is brought to a position capable of passing the notch 82, the first regulating portion 76 is rendered in a rotatable state. Furthermore, when the first regulating portion 76 is rendered rotatable, the second regulating portion 78 that the rotation has been regulated by the first regulating portion 76 is also rendered in a rotatable state. That is, at a time of the descent of the pickup roller 50, according to the displacement of the locking portion (displacement portion) 58, the regulation of the movement of the original by the first regulating portion 76 and the second regulating portion 78 can be canceled.

When the first width paper is sent-out (picked-up) from the paper placing tray 44 by the pickup roller 50, the first regulating portion 76 is rotated forward by being pushed by the first width paper, and in accordance with this, the second regulating portion 78 is also rotated forward, and accordingly, the first width paper is sent to the paper feeding roller 52. On the other hand, when the second width paper is sent-out from the paper placing tray 44 by the pickup roller 50, the second regulating portion 78 is rotated forward by being pushed by the second width paper, and in accordance with this, the first regulating portion 76 is also rotated forward, and accordingly, the second width paper is sent to the paper feeding roller 52.

Thus, in the first embodiment, in sending-out the original, the cancellation of the regulation of the movement of each of the first width paper and the second width paper can be adequately performed.

The original that is sent-out to the paper feeding roller 52 by the pickup roller 50 is fed to the image reading position 34 by the paper feeding roller 52 and the plurality of feeding rollers 64. The image is read by the image reading portion 32 of the image reading apparatus 14 during the original is being fed above the image reading position 34. The original passing the image reading position 34 is discharged onto the paper discharging tray 46 while being guided to the discharging port 68 by the feeding rollers 64 and the paper discharging roller 66.

According to the first embodiment, since the first regulating portion 76 is arranged outside the second width paper passage area W and the second regulating portion 78 is arranged inside the second width paper passage area W, it is possible to adequately regulate the movement of the second width paper such as a name card toward the downstream side in addition to the first width paper, and intentional entering of each of the first width paper and the second width paper to the paper feeding roller 52 can be prevented. That is, it is possible to adequately feed the second width paper such as a name card in addition to the first width paper such as A4 paper.

Furthermore, in the first embodiment, the engaging mechanism that regulates the rotation of the first regulating portion 76 (that is, regulates the movement of the original) at the time of the standby (at the time of the ascent) of the pickup roller 50 and makes the first regulating portion 76 rotatable (that is, cancels the regulation of the movement) at the time of the operation state (at the time of the descent) of the pickup roller 50, i.e., the locking portion 58, the engaging portion 80 and the notch 82 are provided on the first regulating portion 76 and the pickup holder 56. Furthermore, the second regulating portion 78 is integrally coupled to the first regulating portion 76 by the coupling portion 84 to be linked with the operation of the first regulating portion 76. More specifically, the engaging mechanism with the locking portion (displacement portion) 58 is provided on the first regulating portion 76 that is arranged an external of the pickup holder 56 capable of easily securing a space, and by linking the operation of the second regulating portion 78 with the operation of the first regulating portion 76, without providing an engaging mechanism for linking the second regulating portion 78 with the movement up and down of the pickup roller 50, the regulation and cancel of the movement of the original by the second regulating portion 78 can be linked with the movement up and down of the pickup roller 50, whereby the shape of the second regulating portion 78 can be simplified and thus it becomes possible to arrange the second regulating portion 78 in a limited space within the pickup holder 56. That is, it becomes possible to adequately arrange the second regulating portion 78 inside the second width paper passage area W without making a size of the apparatus large or making the apparatus complicated.

Furthermore, since the second piece 78*b* of the second regulating portion 78 is formed to be extended upward in approximately vertical direction, the height of the second regulating portion 78 can be set lower while the regulation of the movement of the original can be surely performed. Therefore, it is possible to attempt miniaturization and thinning of the apparatus. The first regulating portion 76 and the second regulating portion 78 are arranged collectively at one side of the pickup roller 50, and due to this, it is also possible to attempt the miniaturization of the apparatus.

In addition, in the above-described first embodiment, although the second regulating portion 78 is formed by the first piece 78*a* that is largely inclined toward the downstream side and the second piece 78*b* that is extended in an approximately vertical direction, a shape of the second regulating portion 78 is not limited to this. It is possible to form the second regulating portion 78 in a manner of a plate that is extended from the coupling portion 84 with a constant inclination angle. In such a case, by inclining the second regulating portion 78 larger than the first regulating portion 76, the contacting position of the first regulating portion 76 with original (first width paper) may be set at the upstream side in comparison to the contacting position of the second regulating portion 78 with the original (second width paper). Due to this, the regulating performance for the original can be increased. However, it is unnecessary to arrange the first regulating portion 76 at the upstream side in comparison to the second regulating portion 78, and the first regulating portion 76 and the second regulating portion 78 may be arranged in parallel with each other.

[Second Embodiment]

Next, with referring to FIG. 10 to FIG. 13, a paper feed apparatus 10 that is a second embodiment according to the present invention will be described. Although the regulating member 74 (the first regulating portion 76 and the second regulating portion 78) is rotated in the original feeding direction in sending-out the original in the above-described first embodiment, this second embodiment is different from the first embodiment in a point that the regulating member 74 is rotated in the direction orthogonally intersecting the original feeding direction. In the following, the paper feed apparatus 10 according to the second embodiment will be described with referring to FIG. 10 to FIG. 13, but by applying the same reference numerals for components common to the above-described first embodiment, a duplicate description will be omitted or simplified. Then, only the regulating member 74 and periphery components thereof will be described.

Figure 10:
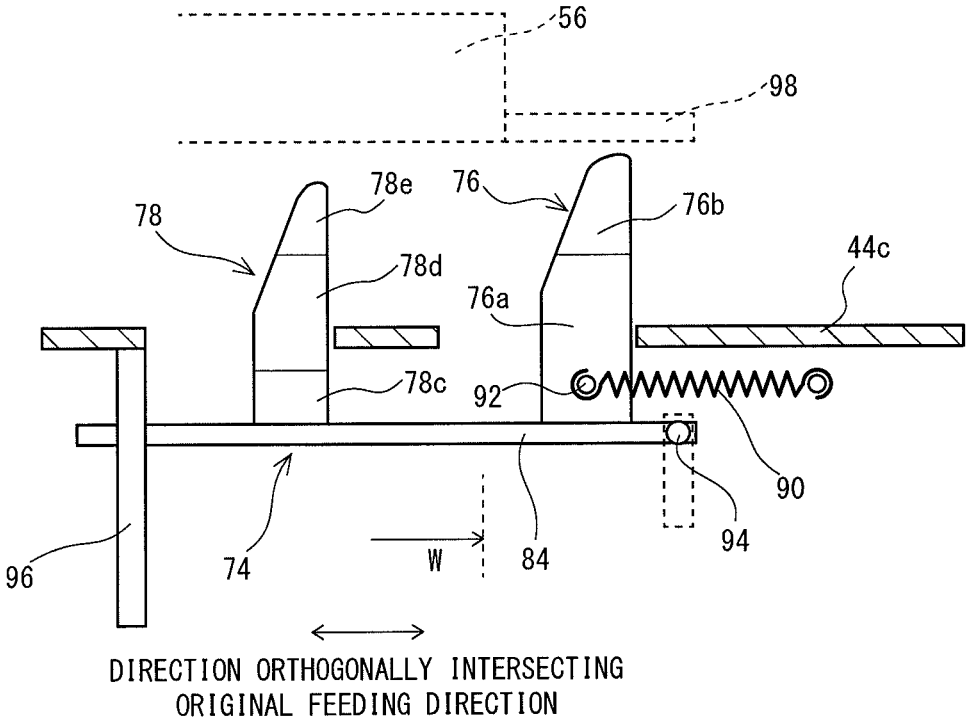
FIG. 10 is a schematic view roughly showing a regulating member and circumferential part thereof that are provided in a paper feed apparatus of a second embodiment according to the present invention.
Figure 11:
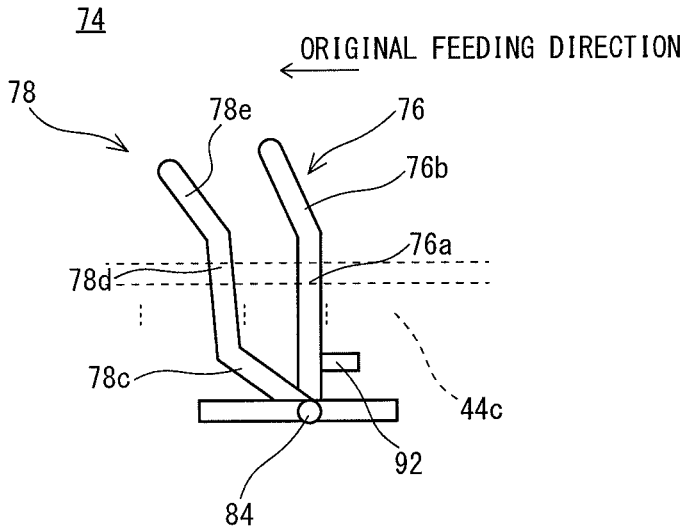
FIG. 11 is a side view showing the regulating member of FIG. 10.

As shown in FIG. 10 and FIG. 11, a regulating member 74 comprises a first regulating portion 76 and a second regulating portion 78. The first regulating portion 76 includes a first piece 76*a* that is extended upward in an approximately vertical direction and a second piece 76*b* that is bent downward from a tip end of the first piece 76*a* and inclined at a predetermined angle. The first regulating portion 76 is arranged outside the second width paper passage area W in the direction orthogonally intersecting the original feeding direction and out of the width of the pickup holder 56 in the direction orthogonally intersecting the original feeding direction. Furthermore, a fixing portion 92 of short-cylinder-like to which one end portion of a tensile member 90 (described later) is connected is provided at a lower end portion of the first piece 76*a* of the first regulating portion 76.

The second regulating portion 78 includes a first piece 78*c* that is inclined toward the downstream side, a second piece 78*d* that is bent from a tip end of the first piece 78*c* and extended upward in approximately vertical direction, and a third piece 78*e* that is bent downstream side from a tip end of the second piece 78*d* and inclined at a predetermined angle. Then, the second regulating portion 78 is arranged inside the second width paper passage area W and within the width of the pickup holder 56 in the direction orthogonally intersecting the original feeding direction. In addition, the second piece 78*d* and the third piece 78*e* of the second regulating portion 78 are arranged at the downstream side in comparison to the first regulating portion 76, and a height of the second regulating portion 78 is set to be lower than a height of the first regulating portion 76.

Figure 12:
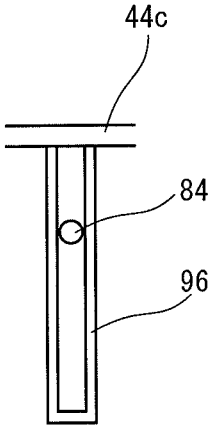
FIG. 12 is a side view showing a guide portion of FIG. 10.

In addition, a base end part of the first regulating portion 76 and a base end part of the second regulating portion 78 are coupled to each other by a coupling portion 84 of a circular cylinder-like. A rotation supporting shaft 94 that is extended in the original feeding direction is provided on an end portion at a side of the first regulating portion 76 of the coupling portion 84, and the regulating member 74 is supported by the rotation supporting shaft 94 in a rotatable manner in the direction orthogonally intersecting the original feeding direction. That is, the first regulating portion 76 and the second regulating portion 78 are rotatable with a fulcrum by the rotation supporting shaft 94 in the direction orthogonally intersecting the original feeding direction. Furthermore, the one end portion of the tensile member 90 that is an elastic member such as a spring, etc. is connected to the fixing portion 92 of the first regulating portion 76, and the regulating member 74 is affected with a force that the regulating member 74 is pulled outward (toward the tensile member 90) in the direction orthogonally intersecting the original feeding direction. Furthermore, the regulating member 74 is held by a holding mechanism (not shown) in a manner movable vertically. Furthermore, as shown in FIG. 10 and FIG. 12, a guide portion 96 that guides an end portion at a side of the second regulating portion 78 of the coupling portion 84 of the regulating member 74 is provided on the downstream part 44*c* of the paper placing tray 44. The guide portion 96 includes two vertical walls spreading in the vertical direction as along with a side surface of the end portion of the coupling portion 84, and a bottom wall that connects lower ends of the vertical walls to each other. In addition, the regulating member 74 may be rotated as a fulcrum by the end portion at a side of the first regulating portion 76 of the coupling portion 84. That is, the rotation supporting shaft 94, the tensile member 90, etc. may be provided on a side of the second regulating portion 78, and the guide portion 96 may be provided on a side of the first regulating portion 76.

When no force from others affecting to the regulating member 74, the first regulating portion 76 and the second regulating portion 78 become in a standing state at an upper position because a tension force of the tensile member 90 affects the regulating member 74. As more understood from FIG. 10 and FIG. 11, in such a standing state at the upper position, the first piece 76*a* and the second piece 76*b* of the first regulating portion 76 and the second piece 78*d* and the third piece 78*e* of the second regulating portion 78 become in a protruded state from the upper surface of the downstream part 44*c* of the paper placing tray 44.

Furthermore, one of the side walls of the pickup holder 56 is formed with a contacting portion 98 that is a plate-like and protruded outward at a position corresponding to the first regulating portion 76. The contacting portion 98 functions as a displacement portion that changes a position at the time of the operation (at a time of the descent) of the pickup roller 50. Then, at the time of the operation of the pickup roller 50, the contacting portion 98 pushes downward the tip end portion of the second piece 76*b* of the first regulating portion 76 so as to displace the first regulating portion 76 (in turn the whole of the regulating member 74) toward a lower position.

In such the paper feed apparatus 10, when an original is to be placed in the paper placing tray 44, the pickup roller 50 is held at the ascent position (standby position). At this time, since the contacting portion 98 of the pickup holder 56 does not push the first regulating portion 76 downward, the first regulating portion 76 and the second regulating portion 78 are rendered in the standing state at the upper position (see FIG. 10).

In a case where the first width paper such as A4 paper is placed in the paper placing tray 44, the first width paper is brought into mainly contact with the first piece 76*a* of the first regulating portion 76. At this time, since the first regulating portion 76 is rendered rotatable in the direction orthogonally intersecting the original feeding direction by the rotation supporting shaft 94 extending in the original feeding direction, and first piece 76*a* of the first regulating portion 76 is extended in approximately vertical direction, even if the first width paper is brought into contact with the first piece 76*a* of the first regulating portion 76, the first regulating portion 76 is not rotated. Therefore, when the pickup roller 50 is rendered at the standby position, the movement of the first width paper in the feeding direction is adequately regulated by the first regulating portion 76 and the first width paper is aligned.

On the other hand, in a case where the second width paper such as a name card is placed in the paper placing tray 44, the second width paper is brought into contact with the second piece 78*d* of the second regulating portion 78. At this time, as similar to the above-described case of the first regulating portion 76, even if the second width paper is brought into contact with the second piece 78*d* of the second regulating portion 78 extending in approximately vertical direction, the second regulating portion 78 is not rotated. Accordingly, when the pickup roller 50 is rendered at the standby position, the movement of the second width paper in the feeding direction is adequately regulated by the second regulating portion 78 and the second width paper is aligned.

Figure 13:
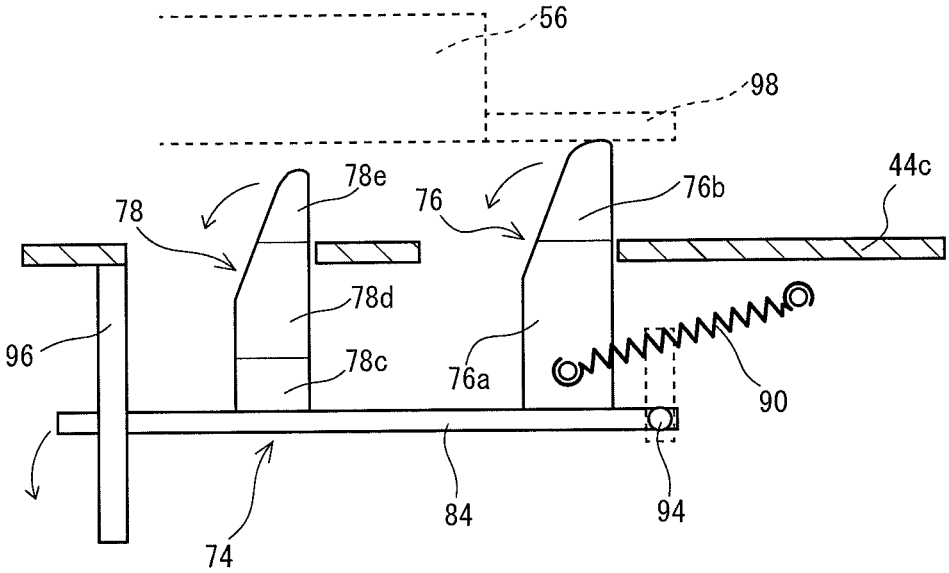
FIG. 13 is a schematic view roughly showing the regulating member and circumferential part thereof that are provided in the paper feed apparatus of FIG. 10 in a state that a pickup roller is descended.

Furthermore, as shown in FIG. 13, when an image is to be read by feeding the original placed in the paper placing tray 44, the pickup holder 56 is rotated downward such that the pickup roller 50 is moved to the descent position (operation position). At this time, since the contacting portion 98 is brought into contact with the tip end portion of the second piece 76*b* of the first regulating portion 76 to push downward the first regulating portion 76, the first regulating portion 76 is displaced to the lower position. Furthermore, the second regulating portion 78 that is integrated with the first regulating portion 76 via the coupling portion 84 is also displaced to the lower position. That is, the regulating member 74 is entirely displaced to the lower position, and the first regulating portion 76 and the second regulating portion 78 are rendered in the standing state at the lower position. In the standing state at the lower position, the second piece 76*b* of the first regulating portion 76 and the third piece 78*e* of the second regulating portion 78 are rendered in a state that these are protruded from the upper surface of the downstream part 44*c* of the paper placing tray 44.

When the first width paper is to be sent-out from the paper placing tray 44 by the pickup roller 50, the second piece 76*b* of the first regulating portion 76 is pushed forward (original feeding direction) by the first width paper. At this time, since the second piece 76*b* of the first regulating portion 76 is inclined toward the downstream side, a force that is applied to the second piece 76*b* in the original feeding direction also acts downward. By such a force that acts downward, the first regulating portion 76 is rotated in the direction orthogonally intersecting the original feeding direction, in accordance with this, the second regulating portion 78 is also rotated in the direction orthogonally intersecting the original feeding direction, whereby the first width paper can be sent-out to the paper feeding roller 52. On the other hand, when the second width paper is to be sent-out from the paper placing tray 44 by the pickup roller 50, the second piece 78*e* of the second regulating portion 78 is pushed toward the original feeding direction by the second width paper. At this time, as similar to the above-described case of the first regulating portion 76, since the second piece 78*e* of the second regulating portion 78 is inclined toward the downstream side, a force that is applied to the second piece 78*e* in the original feeding direction also acts downward. By such a force, the second regulating portion 78 is rotated in the direction orthogonally intersecting the original feeding direction, in accordance with this, the first regulating portion 76 is also rotated in the direction orthogonally intersecting the original feeding direction, whereby the second width paper can be sent-out to the paper feeding roller 52.

That is, in this second embodiment, at the time of the operation of the pickup roller 50, the first regulating portion 76 is pushed by the contacting portion (displacement portion) 98 to be displaced, whereby the regulation of the movement of the first width paper can be canceled. Furthermore, by integrally coupling the first regulating portion 76 and the second regulating portion 78 to each other, the second regulating portion 78 is linked with the displacement (operation) of the first regulating portion 76 to be also displaced, and therefore, at the time of the operation of the pickup roller 50, the regulation of the movement of the second width paper is also canceled.

As described above, as similar to the first embodiment, in the second embodiment, since the first regulating portion 76 is arranged outside the second width paper passage area W and the second regulating portion 78 is arranged inside the second width paper passage area W, it is possible to adequately regulate the movement of the second width paper such as a name card toward the downstream side in addition to the first width paper, and intentional entering of each of the first width paper and the second width paper to the paper feeding roller 52 can be prevented. That is, it is possible to adequately feed the second width paper such as a name card in addition to the first width paper such as A4 paper.

Furthermore, according to the second embodiment, at the time of the operation of the pickup roller 50, since the first regulating portion 76 is pushed by the contacting portion 98, the regulation of the movement of the first width paper by the first regulating portion 76 is canceled, and by linking to this, the regulation of the movement of the second width paper is also canceled. Therefore, it is possible to makes the operation of the second regulating portion 78 link with the motion of the pickup roller 50 without providing an engaging mechanism for linking the second regulating portion 78 with the operation of the pickup roller 50 on the second regulating portion 78, whereby the shape of the second regulating portion 78 can be simplified and thus the second regulating portion 78 can be adequately arranged inside the second width paper passage area W.

In addition, in the above-described first and second embodiments, in view of the miniaturization of the apparatus, the first regulating portion 76 and the second regulating portion 78 are collectively arranged at one side of the pickup roller 50, but not limited to this. It is possible to arrange the first regulating portion 76 at a side of one end portion in the axial direction of the pickup roller 50 and the second regulating portion 78 at a side of another end portion.

[Third Embodiment]

Subsequently, a paper feed apparatus 10 that is the third embodiment according to the present invention will be described. The third embodiment is different from the first and second embodiments in a point that although the first regulating portion 76 and the second regulating portion 78 are arranged only at one side of the pickup roller 50 in the above-described first and second embodiments, in the third embodiment, each of the first regulating portion 76 and the second regulating portion 78 is arranged at each of both sides of the pickup roller 50. That is, in the third embodiment, although not shown, at respective sides of the pickup roller 50, the first regulating portion 76 is provided outside the second width paper passage area W in the direction orthogonally intersecting the original feeding direction and the second regulating portion 78 is provided inside the second width paper passage area W in the direction orthogonally intersecting the original feeding direction, so that the first width paper and the second width paper are brought into contact with the first regulating portion 76 and the second regulating portion 78 at two points in the direction orthogonally intersecting the original feeding direction to be regulated. Since the structure similar to the first and second embodiment can be adopted as for the structure of others, a duplicated description is omitted here.

According to the third embodiment, an effect to miniaturize the apparatus becomes smaller; however, intentional entering of each of the first width paper and the second width paper to the paper feeding roller 52 can be prevented more surely. In addition, it is possible to arrange only one of the first regulating portion 76 and the second regulating portion 78 at the both sides of the pickup roller 50.

In addition, in the above-described respective embodiments, the first regulating portion 76 and the second regulating portion 78 are integrated to be linked with each other; however, the first regulating portion 76 and the second regulating portion 78 are not needed to be integrated necessarily. In such a case, however, there occurs necessity that the second regulating portion 78 is also provided with an engaging mechanism or a rotation regulating means that makes the second regulating portion 78 link with the vertical motion of the pickup roller 50.

Furthermore, in the above-described respective embodiments, the pickup roller 50 that ascends at a time of the standby and descends at the time of the operation is used as a paper feeding portion that sends-out a paper placed in the paper placing tray; however, it is possible to use a pickup roller 50 that descends at the time of the standby and ascends at the time of the operation, that is, the standby position and the operation position are reverenced up and down. Furthermore, it is possible to use a D-type roller or the like as a paper feeding portion instead of the pickup roller 50.

Furthermore, in the above-described respective embodiments, the paper feeding portion (the pickup roller 50) is arranged in a center portion of the paper placing tray 44 in its width direction, and thus, the second width paper passage area W is also set in the center portion of the width direction; however, in a case where the paper feeding portion is arranged in an end portion of the paper placing tray 44 in its width direction, the second width paper passage area W is also set in the end portion of the width direction.

Furthermore, in the above-described respective embodiments, a paper (original) to read an image is fed, that is, the paper feed apparatus 10 is applied to the ADF (Automatic Document Feeder), but not limited to this. The paper feed apparatus 10 can be applied to a mechanism in that a paper that an image is to be printed (recording paper) is fed from a manual feeding tray, a paper feeding cassette, etc., for example.

Furthermore, in the above-described respective embodiments, the paper feed apparatus 10 is applied to the multi-function machine (image forming apparatus) 100 that the machine body 12 including the image forming portion 24 and the image reading apparatus 14 are integrated, but not limited to this. The image reading apparatus 14 comprising the paper feed apparatus 10 may be an individual product, for example. In such a case, the image reading apparatus 14 may transmit an image that is read to a personal computer, another image forming apparatus, etc. being connected to a network, for example.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A paper feed apparatus that feeds a paper placed in a paper placing tray, comprising:

a pickup roller that is provided movably between a standby position and an operation position and sends-out a paper placed in the paper placing tray;

a pickup holder that is provided movably between the standby position and the operation position and holds the pickup roller rotatably;

a first regulating portion that regulates a movement of the paper placed in the paper placing tray in a feeding direction, at a downstream side of a feeding position by the pickup roller in a paper feeding direction and outside of the width of the pickup holder in a direction orthogonally intersecting the paper feeding direction; and a second regulating portion that regulates the movement of the paper placed in the paper placing tray in the feeding direction, at the downstream side of the feeding position by the pickup roller in the paper feeding direction and within the width of the pickup holder in the direction orthogonally intersecting the paper feeding direction, wherein the first regulating portion and the second regulating portion are arranged at one side in an axial direction of the pickup roller.

2. The paper feed apparatus according to claim 1, wherein each of the first regulating portion and the second regulating portion regulates a movement of a paper at a time of the standby of the pickup roller and cancels such the regulation at a time of the operation of the pickup roller.

3. The paper feed apparatus according to claim 1, wherein a portion of the first regulating portion contacting with the paper is arranged at an upstream side in the paper feeding direction of a portion of the second regulating portion contacting with the paper.

4. An image reading apparatus, comprising the paper feed apparatus according to claim 1.

5. An image forming apparatus, comprising the paper feed apparatus according to claim 1.

6. A paper feed apparatus that feeds a paper placed in a paper placing tray, comprising:

a pickup roller that is provided movably between a standby position and an operation position and sends-out a paper placed in the paper placing tray;

a pickup holder that is provided movably between the standby position and the operation position and holds the pickup roller rotatably;

a first regulating portion that regulates a movement of the paper placed in the paper placing tray in a feeding direction, at a downstream side of a feeding position by the pickup roller in a paper feeding direction; and a second regulating portion that regulates the movement of the paper placed in the paper placing tray in the feeding direction, at the downstream side of the feeding position by the pickup roller in the paper feeding direction and a position of the pickup roller side in a direction orthogonally intersecting the paper feeding direction in comparison to the first regulating portion, and the first regulating portion and the second regulating portion are arranged at one side in an axial direction of the pickup roller, wherein each of the first regulating portion and the second regulating portion is movable between a position for regulating the movement of the paper and a position for feeding the paper, and regulates the movement of the paper at a time of the standby of the pickup roller and cancels such regulation at a time of the operation of the pickup roller.

7. The paper feed apparatus according to claim 6, wherein the first regulating portion is arranged outside of the width of the pickup holder in the direction orthogonally intersecting the paper feeding direction, and the second regulating portion is arranged within the width of the pickup holder in the direction orthogonally intersecting the paper feeding direction.

8. The paper feed apparatus according to claim 6, wherein a portion of the first regulating portion contacting with the paper is arranged at an upstream side in the paper feeding direction of a portion of the second regulating portion contacting with the paper.

9. An image reading apparatus, comprising the paper feed apparatus according to claim 6.

10. An image forming apparatus, comprising the paper feed apparatus according to claim 6.

11. A paper feed apparatus that feeds a paper placed in a paper placing tray, comprising:

a pickup roller that is movable between a standby position and an operation position and sends-out a paper placed in the paper placing tray;

a pickup holder that is movable between the standby position and the operation position and holds the pickup roller rotatably;

a first regulating portion that regulates a movement of the paper placed in the paper placing tray in a feeding direction, at a downstream side of a feeding position by the pickup roller in a paper feeding direction and outside of the width of the pickup holder in a direction orthogonally intersecting the paper feeding direction; and a second regulating portion that regulates movement of the paper placed in the paper placing tray in the feeding direction, at the downstream side of the feeding position by the pickup roller in the paper feeding direction and within the width of the pickup holder in the direction orthogonally intersecting the paper feeding direction, wherein each of the first regulating portion and the second regulating portion is movable between a position for regulating the movement of the paper and a position for feeding the paper.

12. The paper feed apparatus according to claim 11, wherein a portion of the first regulating portion contacting with the paper is arranged at an upstream side in the paper feeding direction of a portion of the second regulating portion contacting with the paper.

13. An image reading apparatus, comprising the paper feed apparatus according to claim 11.

14. An image forming apparatus, comprising the paper feed apparatus according to claim 11.

* * * * *